US005884424A

United States Patent [19]

Smith

[11] Patent Number: 5,884,424

[45] Date of Patent: Mar. 23, 1999

[54] ROLL-UP SIGN

[76] Inventor: David A. Smith, 1135 C.R. 620, Ashland, Ohio 44805

[21] Appl. No.: 800,618

[22] Filed: Feb. 14, 1997

[51] Int. Cl.[6] ..... G09F 15/00

[52] U.S. Cl. ..... 40/610; 40/603; 40/607; 160/351; 160/402

[58] Field of Search ..... 40/603, 604, 606, 40/607, 610, 612, 658, 666; 160/351, 383, 385, 402

[56] References Cited

U.S. PATENT DOCUMENTS

| | | | |
|---|---|---|---|
| 296,299 | 4/1884 | Swan | 160/402 |
| 410,020 | 8/1889 | Presler . | |
| 839,501 | 12/1906 | Munro . | |
| 965,097 | 7/1910 | Fisher . | |
| 1,325,519 | 12/1919 | Jenkins . | |
| 1,406,916 | 2/1922 | Arnold . | |
| 1,605,056 | 11/1926 | Newman . | |
| 2,048,359 | 7/1936 | Snell | 40/125 |
| 2,188,466 | 1/1940 | Willemain | 40/125 |
| 2,292,785 | 8/1942 | Henne | 40/125 |
| 2,581,762 | 1/1952 | Hesse | 40/17 |
| 2,703,890 | 3/1955 | Rinaldy | 5/337 |
| 2,722,420 | 11/1955 | Adamson | 273/102 |
| 2,805,504 | 9/1957 | Stein | 40/125 |
| 2,899,204 | 8/1959 | Ratay | 273/102 |
| 3,037,311 | 6/1962 | Ross et al. | 40/125 |
| 3,042,053 | 7/1962 | Gabriel | 135/5 |
| 3,079,965 | 3/1963 | Troy | 150/1 |
| 3,195,898 | 7/1965 | Respini | 273/181 |
| 3,289,337 | 12/1966 | Golkowski | 40/125 |
| 3,310,899 | 3/1967 | Hart et al. | 40/604 |
| 3,355,174 | 11/1967 | Hutson | 273/102 |
| 3,464,479 | 9/1969 | Baker | 160/402 X |
| 3,500,789 | 3/1970 | Keats | 116/173 |
| 3,581,420 | 6/1971 | Mollet et al. | 40/125 |
| 3,591,940 | 7/1971 | Slemmons | 40/125 G |
| 3,979,846 | 9/1976 | Euzarraga | 40/610 X |
| 4,103,445 | 8/1978 | Smith et al. | 40/125 |
| 5,408,770 | 4/1995 | Suzuki | 40/603 X |
| 5,791,391 | 8/1998 | Carter | 160/135 |

FOREIGN PATENT DOCUMENTS

| | | | |
|---|---|---|---|
| 2504171 | 8/1976 | Germany | 40/610 |

*Primary Examiner*—Kenneth J. Dorner
*Assistant Examiner*—Andrea Chop
*Attorney, Agent, or Firm*—Pearne, Gordon, McCoy & Granger LLP

[57] ABSTRACT

A portable roll-up sign having a simplified and economical construction. The sign face is a flexible pvc based sheet that can be imaged on both sides with vinyl graphics or silk screen inks. The sign frame comprises two vertical legs and an intermediate header, all field assembled by mutual interlocking without fasteners or tools. Vertical edges of the face sheet are joined to respective legs by the sign manufacturer by wrapping the same through at least a full turn and clamping with specially shaped retaining clips.

16 Claims, 3 Drawing Sheets

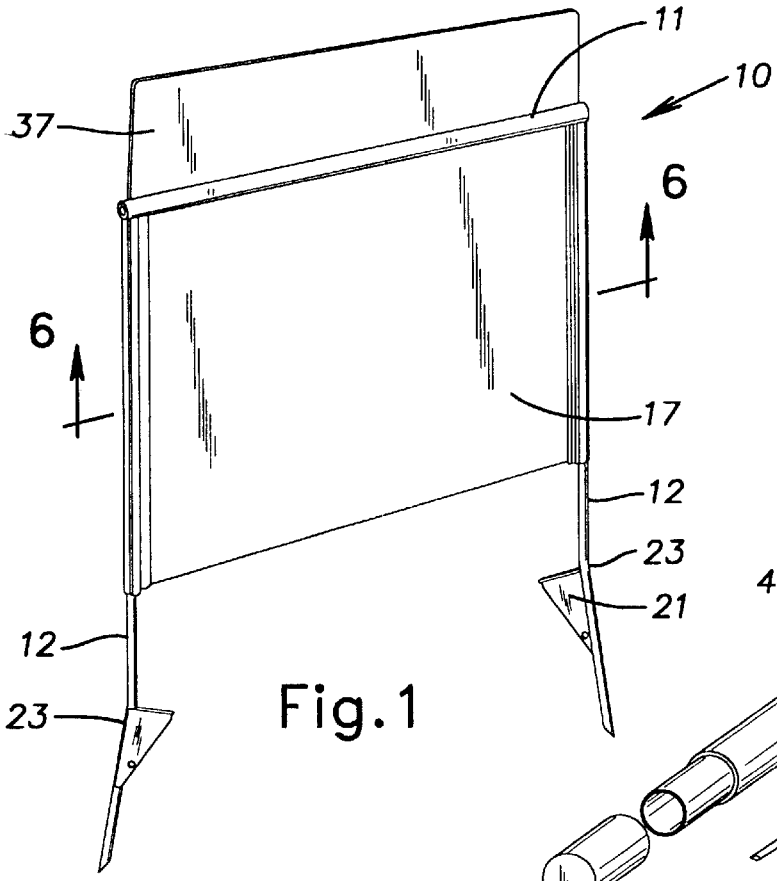
Fig.1
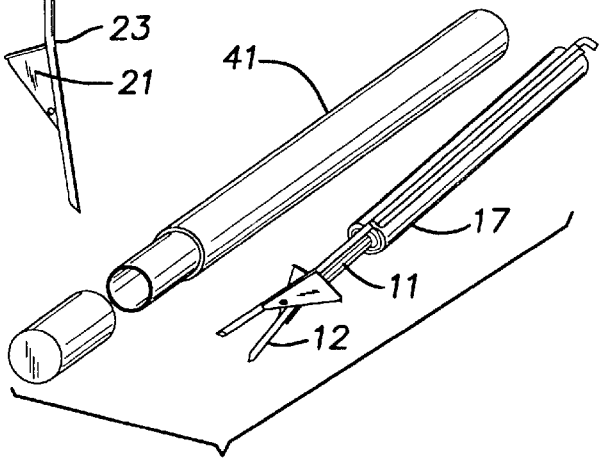
Fig.2
Fig.3
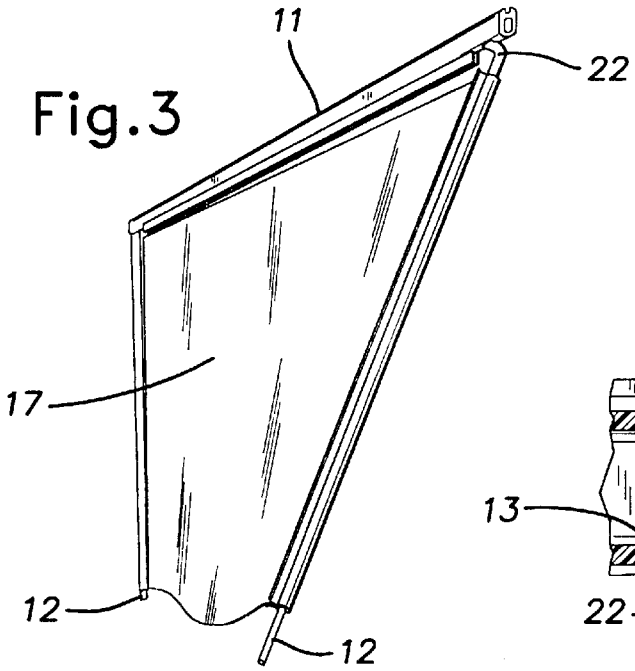
Fig.4
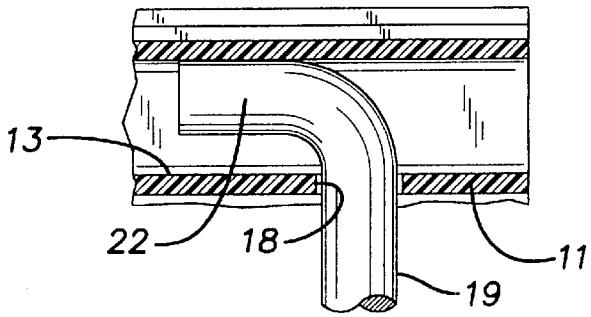

Fig.6
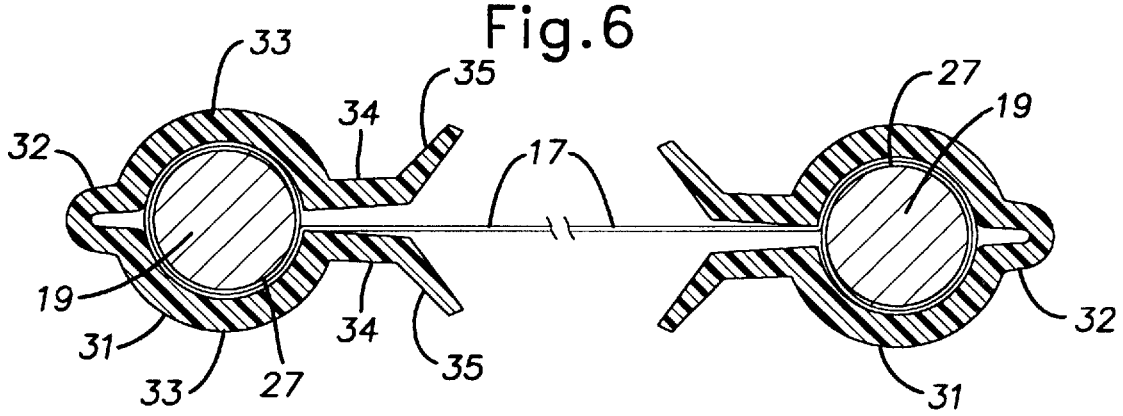
Fig.5
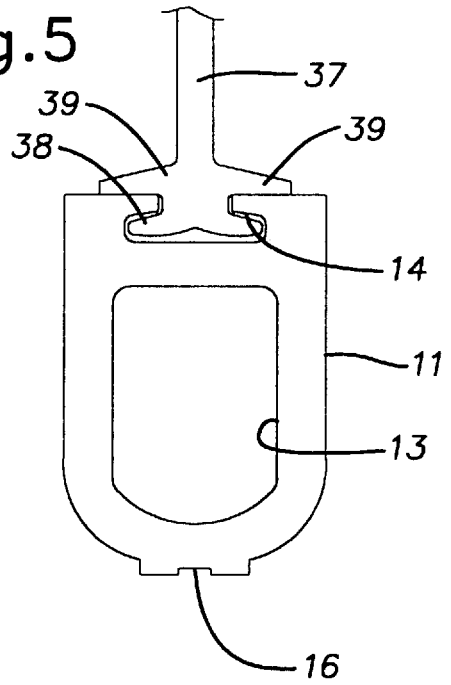
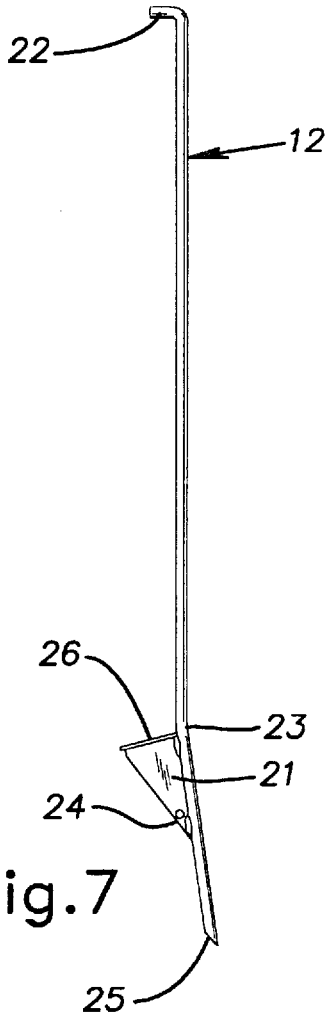
Fig.7

ROLL-UP SIGN

BACKGROUND OF THE INVENTION

The invention relates to improvements in portable outdoor signs and, in particular, to signs of the type with flexible display faces and rigid perimeter frames.

PRIOR ART

My U.S. Pat. No. 4,103,445 discloses a novel sign construction that offers significant advantages over prior art signs such as portable metal faced outdoor real estate signs. The patented structure includes a flexible sign face made of thermoplastic rubber (TPR) that can be rolled up or coiled around rigid field assembled perimeter frame elements. The roll-up feature enables the sign to be economically packaged and shipped and conveniently stored and handled. The flexible face is highly resistant to damage from accidental or deliberate blows from solid objects and is corrosion proof. A serious disadvantage of the disclosed TPR material is its relatively high cost making it difficult to obtain favorable economic advantage over traditional sign constructions. Still further, the method of attaching the flexible face of the sign to the frame legs disclosed in the aforementioned patent, while effective is somewhat tedious, time consuming an requires relatively high skill to effect a high quality appearance in assembly.

SUMMARY OF THE INVENTION

The invention provides an improved roll-up sign that results from a novel combination of components and assembly techniques. The sign structure provides an attractive quality appearance while allowing it to be formed of inexpensive materials and be sub-assembled with minimal manual effort and skill.

In the illustrated embodiment, the sign face sheet is a multi-layer vinyl product that includes an inner opaque layer which allows the sign to be a double-face unit without a shadow of the image of one side being visible on the other side.

In use, the sign face is supported by rigid frame elements that are field assembled by interlocking them together without separate fasteners. The frame elements comprise a pair of spaced generally vertical legs and an upper cross bar extending between the legs. The sign face sheet is preassembled to the frame legs by the sign manufacturer. This sub-assembly involves a technique of wrapping the face sheet edges or margins around the legs and locking these margins in their wrapped configuration with a grip or clip that presses the wrapped sheet edges against the legs. Preferably, the assembly of the sheet edges to the legs is assisted by adhesive means in the form of a double-sided tape applied to the sheet edges and adhered to the legs as they are wrapped by the sheet edges.

BRIEF DESCRIPTION OF THE DRAWINGS

FIG. 1 is a perspective view of a sign assembly constructed in accordance with the present invention;

FIG. 2 is a perspective view of the sign assembly of FIG. 1 in a collapsed rolled-up condition and a convenient shipping and storage tube for carrying the roll-up assembly;

FIG. 3 illustrates the manner in which the legs of the frame are assembled and interlocked with the cross bar of the frame;

FIG. 4 is an enlarged, fragmentary view of respective end areas of a leg and cross piece in interlocked relation;

FIG. 5 is an end view of the cross bar and an add-on sign face illustrating their respective cross-sections;

FIG. 6 is a sectional view of the retaining clip members taken in the plane 6—6 indicated in FIG. 1 for securing respective edge margins of the collapsible sign face to the frame legs;

FIG. 7 illustrates details of the construction of a leg;

DESCRIPTION OF THE PREFERRED EMBODIMENT

Figure 8:
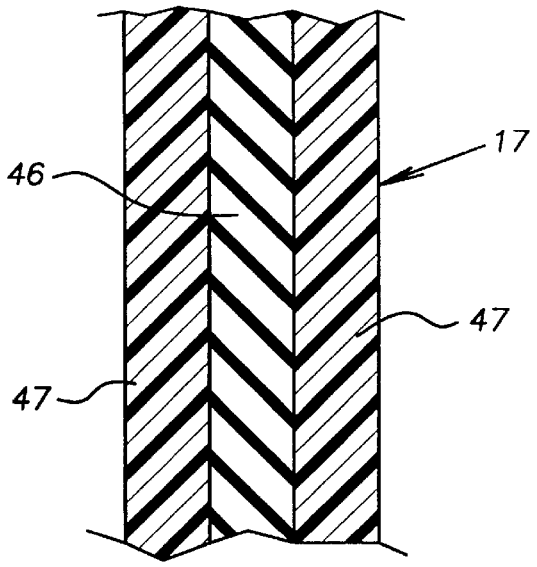
FIG. 8 is an enlarged fragmentary cross-sectional view of the sign face sheet.
Figure 9:
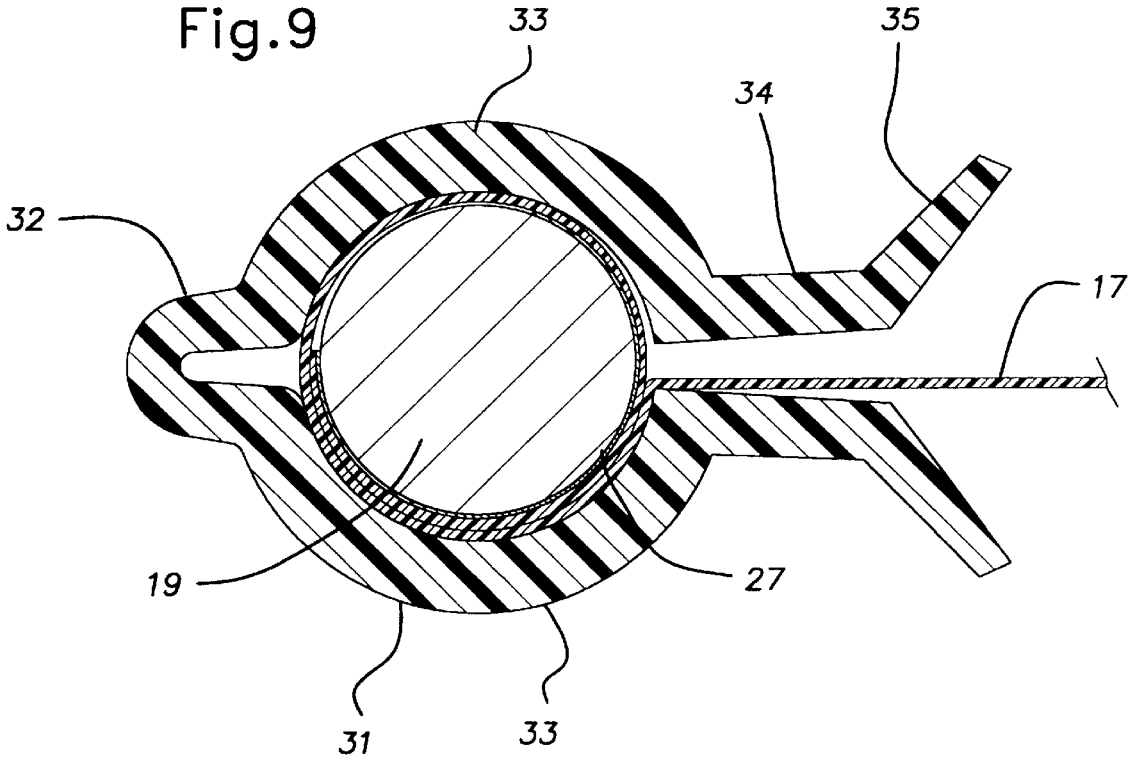
FIG. 9 is an enlarged fragmentary cross-sectional view of one vertical leg of the sign and other related sign elements.

Reference to the aforementioned U.S. Pat. No. 4,103,445 may be made for additional details of the general type of sign disclosed herein.

Referring now to the drawings, FIG. 1 illustrates a sign 10 constructed in accordance with the present invention. The sign 10 comprises a rigid frame and a flexible sheet forming the display faces of the sign. The frame is formed of a horizontal cross bar or header 11 and a pair of vertical legs 12 depending from opposite ends of the cross bar.

The illustrated cross bar 11 is formed has an extrusion of suitable plastic such as rigid polyvinyl chloride (pvc). FIG. 5 illustrates the cross-section of the cross bar 11. The cross bar is a hollow tube with a through bore 13. At an upper side, the cross bar is formed with a longitudinal dovetail groove 14. At its lower side, the cross bar 11 is formed with a shallow groove 16 arranged to receive an upper edge of the sign face sheet designated 17. Adjacent each of its ends, the cross bar 11 is drilled or otherwise formed with a vertical hole 18 through its lower wall for receiving one of the legs 12 as described below.

Preferably, the legs 12 are identical with each leg being a weldment of an elongated round steel bar 19 of ⅜" diameter, for example, and a triangular sheet steel foot step bracket or pedal 21. At the top, the leg 19 is bent at 90° to form a short transverse extension 22. The extension 22 and the foot pedal 21 lie in the same plane and project in the same direction. At a point 23 adjacent the top of the pedal 21, the bar 19 is bent slightly outwardly at an angle of, for example 1½°. The bend causes the lower portion of the leg 12 below the point 23 to diverge with respect to the longitudinal axis of the main part of the leg in the plane of the extension 22 and pedal 21 in the direction opposite these elements. A hole 24 in the pedal 21 permits the leg 12 to be suspended by a hook to facilitate powder coating or paint spraying. A flange 26 bent out of the plane of the sheet metal of the pedal 21 at the top edge of the pedal reduces pressure when a person installing the sign steps on the pedal. At its lower end 25 the leg is pointed by shearing or otherwise cutting it on a plane that extends horizontally outwardly and downwardly.

The material forming the sign face sheet 17 is, preferably, a multilayer sheet of pvc. A suitable material is a multilayer heat laminated pvc sheet stock used for outdoor banners. It has a central layer 46 that is filled with a suitable agent such as carbon black to render it opaque so that the sheet can be imaged on both outer sides or faces without a shadow image of one side being seen on the other side. A suitable sheet material has a total thickness in the order of 0.015 inches, for example, and is sufficiently flexible and resilient to be readily rolled on itself without effort or damage. The surfaces of the outer layers 47 of the preferred composite face sheet 17 are formed or treated so that they are receptive to silk screen inks and pressure-sensitive adhesive coated vinyl graphics widely used by sign shops. The face sheet material is relatively strong and flexible, has good outdoor properties and when tensioned in a manner to be described is relatively wrinkle free. A suitable material for the face sheet has the following properties.

| | Typical Data |
|---|---|
| Total Weight oz/sq.yd | 12.5 |
| Tensile Strength lb/in(MD/CD) | 125/134 |
| Tear Strength lb(MD/CD) | 13.4/8.1 |
| Elongation %(MD/CD) | 37/38 |
| Grab Tensile lb/in(MD/CD) | 222/196 |
| Opacity | 100% |

MD is Machine Direction
CD is Cross-Direction

The vertical edges or margins of the face sheet 17 are fixed to the legs 12 in a novel manner. At both vertical edges of the sign face 17, a double-sided pressure-sensitive tape such as a ¾" wide outdoor carpet tape is applied first to the sheet margin and then the sheet margin is wrapped on the leg 12 with the tape in contact with the leg. The tape, designated 27, at opposite vertical edges of the face sheet is applied to opposite sides of the face sheet. As shown in FIG. 6, the sheet 17 is wrapped through an angle of more than 360° and, preferably through an angle of at least about 1½ turns or 540°. In this construction, tension in the sheet 17 tends to tighten the grip of the sheet on the leg 12 and thereby tends to prevent the margins of the sheet from slipping off the associated leg.

The vertical sheet edges or margins are retained on the legs 12 by novel clips or retainers 31 provided in identical form on both legs. A clip 31 is ideally formed as an extrusion of rigid pvc such as that formulated for use in storm windows. Such material has excellent weather properties and is economical. As shown in FIG. 6, the clips 31 have a cross-sectional shape analogous to a hair pin. Preferably, the clips extend along the full vertical length of the vertical edges of the face sheet 17. The retainer clip cross-section includes a U-shaped portion 32, opposed arcuate portions 33, opposed flat portions 34 and opposed diverging or flange portions 35. The flange portions 35 serve to force the opposed flat and circular portions 34, 33 apart to allow the clip to spring onto the face sheet wrapped areas of a respective leg 12. The U-shaped portion 32 resiliently flexes open in a manner of a hinge to accommodate this installation but is sufficiently rigid to cause the circular portions 33 to snap closed onto the margins of the sheet wrapped on the associated leg 12. The clip 31 is proportioned, when installed, so that its circular arcuate portions 33 tightly press the marginal areas of the sheet 17 from diametrally opposite sides of the leg 12.

As shown in FIG. 6, the legs 12 are wrapped by the sheet 17 in an identical manner so that the subassembly of the sheet and legs has central symmetry about an imaginary central vertical line in the nominal plane of the sign. An add-on strip or plate 37 can be used with the sign 10. The illustrated plate 37 is extruded or molded of relatively rigid pvc, for example. Along the full length of its lower edge, the plate 37 has an integral dovetail 38 proportioned to fit in the cross bar groove 14. Spaced above and parallel to the dovetail 38, the plate 37 has stabilizing flanges 39 on its opposite faces. The plate 37 is assembled on the cross bar 11 by sliding the dovetail 38 endwise into the groove 14. The flanges 39 abut the top of the cross bar 11 to hold the plate in an upright position.

Ordinarily, the manufacturer of the sign permanently joins the face sheet 17 to the legs 12 with the retaining clips 31 and tape 27 as described. Typically, the face sheet 17 is imaged, by vinyl graphics or silk screen ink, at a sign shop that purchases the sign from the manufacturer. The sign, before and after graphics are applied, can be advantageously stored, handled and shipped in a rolled-up condition. The sign face sheet 17 can be wrapped around the legs 12 and the cross bar to minimize the bulk of the sign. The rolled-up components can readily be put in a mailing tube 41.

The sign 10 is assembled in the field where it is to be installed. The person installing it simply takes the legs 12, one at a time, and joins them to the cross bar 11. This is done, without separate fasteners, in the simple manner illustrated in FIG. 3 where a leg projection or extension 22 is inserted into a respective hole 24 in the cross bar. The legs 12 are each oriented so that the projection 22 points towards the mid-length of the cross bar 11. Once the legs 12 are hooked into the cross bar 11 as just described, the sign is ready to be installed. The installer assures that the legs 12 are spread to tension the face sheet 17 and then steps on the pedals 21 to anchor the sign in place in the ground. The diverging angle of the lower ends of the legs 12 and the position of the pedals 21 on the inside of the legs tend to cause the legs to be slightly spaced from one another as they are driven into the ground thereby further tensioning the sign face to assure that it is drawn flat for a good appearance. Ideally, the legs are driven into the ground to a point where the pedals 21 are buried and they enhance the stability of the sign.

Any tendency of the face sheet margins to unwind from a leg 12 due to tension in the sheet 17 is restricted by the interconnection of the leg to the cross bar provided by the projection 22 which is confined in the longitudinal bore 13 of the cross bar 11 and thereby prevents the leg from rolling or turning about its longitudinal generally vertical axis. The central symmetry of the wrapping of the sheet margins on the legs assists in keeping the face of the sign generally centered under the cross bar where the sheet tends to unwind from the legs and extend from points of tangency from the legs.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What I claim is:

1. A portable sign comprising three elongated rigid frame elements, a flexible non-metallic rectangular sheet capable of being resiliently rolled on itself and providing opposite display faces, and a pair of elongated retainer elements, the sheet being connected to a pair of the frame elements on an opposite pair of edges, the third frame element being interconnected and extending between said pair of frame elements and being parallel to a free edge of the sheet, the third frame element being dimensioned with respect to the sheet, the manner of interconnection of the sheet to the pair of frame elements and the interconnection of the frame elements to maintain the sheet in an extended generally flat configuration, the edges of the sheet connected to the pair of frame elements each being wrapped around an associated frame element through an angle in excess of 360°, the retainer elements each being arranged on a respective frame element to squeeze areas of the sheet wrapped around the respective one of the frame elements at opposite sides of the respective frame element, the edges of said sheet wrapped on said pair of frame elements being adhered to said frame elements by a medium interposed between each of said sheet edges and the respective one of said frame elements.

2. A sign as set forth in claim 1, wherein said retainer elements have a hollow cross-section and are adapted to resiliently engage areas of the sheet.

3. A sign as set forth in claim 2, wherein said retainer elements are adapted to laterally snap over the sheet wrapped areas of the pair of frame elements.

4. A sign as set forth in claim 3, wherein said pair of frame elements have round cross-sections.

5. A sign as set forth in claim 4, wherein the retainer elements have circular arcuate cross-sectional areas.

6. A sign as set forth in claim 5, wherein the retainer elements each have a hairpin cross-sectional area between opposed circular arcuate cross-sectional areas.

7. A sign as set forth in claim 6, wherein portions of each retainer element distal from the hairpin cross-sectional area are flared outwardly from one another to facilitate assembly onto respective ones of the sheet wrapped pair of frame elements.

8. A sign as set forth in claim 1, wherein said sheet is made of silk screen ink and pressure-sensitive adhesive coated vinyl receptive surfaces.

9. A sign as set forth in claim 8, wherein said sheet is comprised of three layers, a center layer of said three layers being opaque.

10. A sign as set forth in claim 9, wherein said sheet is about 0.015 inch thick.

11. A sign as set forth in claim 1, wherein said medium is a double-sided tape.

12. A sign as set forth in claim 1, wherein the interconnection of said frame elements includes elements that prevent rotation of the pair of frame elements about an axis parallel to their length.

13. A sign as set forth in claim 12, wherein the pair of frame elements include pointed ends to enable such elements to be driven generally vertically into the soil, said third frame element being arranged to form a horizontal header above said sheet.

14. A sign as set forth in claim 1, wherein said edges of said sheet wrapped around said frame elements are wrapped at one frame element in a direction opposite the direction of wrap at the other frame element.

15. A portable sign comprising three elongated rigid frame elements, a flexible non-metallic rectangular sheet capable of being resiliently rolled on itself and providing opposite display faces, the sheet being connected to a pair of the frame elements on an opposite pair of edges, the third frame element being releaseably interconnected and extending between said pair of frame elements and being parallel to a free edge of the sheet, the third frame element being dimensioned with respect to the sheet, the manner of interconnection of the sheet to the pair of frame elements and the interconnection of the frame elements to maintain the sheet in an extended generally flat configuration, the edges of the sheet connected to the pair of frame elements each being wrapped around an associated frame element through an angle in excess of 360°, the edges of said sheet wrapped on said pair of frame elements being adhered to said frame elements by a medium interposed between the surfaces of each of said sheet edges and the respective one of said frame elements and retainer means extending along each of the pair of frame elements to hold the sheet edges in position on such frame elements and thereby augment the retention of said edges by said medium.

16. A sign as set forth in claim 15, wherein said edges of said sheet wrapped around said frame elements are wrapped at one frame element in a direction opposite the direction of wrap at the other frame element.

* * * * *